United States Patent [19]

DiBartolo

[11] Patent Number: 4,572,504

[45] Date of Patent: Feb. 25, 1986

[54] HOLDER FOR BREAKABLE KARATE BOARD

[76] Inventor: Alfred DiBartolo, 8217 Corbett Ave., Pennsauken, N.J. 08109

[21] Appl. No.: 678,835

[22] Filed: Dec. 6, 1984

[51] Int. Cl.[4] ..... A63B 69/00

[52] U.S. Cl. ..... 272/76

[58] Field of Search ..... 272/76, 77, 78, 66, 272/105, DIG. 4; 211/175; 248/298

[56] References Cited

U.S. PATENT DOCUMENTS

| | | | |
|---|---|---|---|
| 3,502,330 | 3/1970 | Cheftel | 272/65 X |
| 3,711,053 | 1/1973 | Drake | 248/298 |
| 4,295,646 | 10/1981 | Squire | 272/76 |
| 4,365,800 | 12/1982 | Hay et al. | 272/76 |
| 4,403,772 | 9/1983 | Stangle | 272/76 X |

FOREIGN PATENT DOCUMENTS

| | | | |
|---|---|---|---|
| 2547190 | 4/1977 | Fed. Rep. of Germany | 272/76 |

OTHER PUBLICATIONS

"Power Fist" Board Holder by Martial Arts TM Supplies Co., Inc. Los Angeles, Calif. and New York, N.Y. Black Belt Magazine, p. 18, Jan. 1976.

*Primary Examiner*—Robert E. Bagwill
*Assistant Examiner*—Arnold W. Kramer
*Attorney, Agent, or Firm*—Duffield & Lehrer

[57] ABSTRACT

A holder for breakable karate boards includes upper and lower spaced apart horizontal frame members secured to a vertical support for mounting the same on a wall. The free forward end of each frame member carries a track which faces the track of the other frame member for holding a karate board therebetween and in a vertical position. The width of the tracks are adjustable so that a plurality of boards can be held and each track is movable forwardly and rearwardly relative to the other so that the board or boards can be tilted either upwardly or downwardly. A bracket is provided for mounting the holder on a wall in any desired vertical position. The holder can also be removed from the bracket and mounted on various other pieces of equipment.

5 Claims, 7 Drawing Figures

HOLDER FOR BREAKABLE KARATE BOARD

BACKGROUND OF THE INVENTION

The present invention is directed toward a holder for breakable karate boards and more particularly toward such a device which is capable of selectively holding a single board or a plurality of boards and which is adjustable so that the board can be tilted at an upward or downward angle. The entire holder is also movable upwardly and downwardly to adjust the height of the board above the ground.

In the practice of karate and other similar martial arts, a common exercise consists of the breaking of boards with a person's hand or foot. This is generally accomplished by one or more other persons holding a common wooden board for the karate student to strike. Recently, reusable boards have been developed which are comprised of two interfitting board halves.

The difficulties with the foregoing arrangement are obvious. First, the karate student cannot practice alone but must have at least one other person available to hold the board. Secondly, it is difficult for others to steadily and securely hold the board in the proper position which can result in injury to the student.

Mechanical devices for holding a board have been proposed. One such device is described, for example, in U.S. Pat. No. 4,295,646. The device shown therein includes a frame which is adapted to be mounted to a wall and which also includes a pair of spaced apart channel members which are adapted to hold a single board therein in a substantially vertical position. While this device solves some of the problems of manually holding the board, it is still deficient in that no means are provided for holding more than a single board nor can the position of the board be adjusted either vertically or at an angle to the vertical.

Another proposed device for holding boards is shown on Page 18 of the January 1976 issue of *Black Belt* magazine. This device is comprised of a relatively simple U-shaped frame which is adapted to be mounted on a wall or floor and which also has opposed channel members for holding a board therein. One of the side walls of each of the upper and lower channel members, however, is movable so that up to six boards can be held. Again, however, no means are provided for adjusting the height of the board or the angular orientation thereof.

SUMMARY OF THE INVENTION

The present invention is designed to overcome all of the deficiencies of the prior art described above. This is accomplished according to the present invention by providing a holder for breakable karate boards which includes upper and lower spaced apart horizontal frame members secured to a vertical support for mounting the same on a wall. The free forward end of each frame member carries a track which faces the track of the other frame member for holding a karate board therebetween and in a vertical position. The width of the tracks are adjustable so that a plurality of boards can be held and each track is movable forwardly and rearwardly relative to the other so that the board or boards can be tilted either upwardly or downwardly. A bracket is provided for mounting the holder on a wall in any desired vertical position. The holder can also be removed from the bracket and mounted on various other pieces of equipment.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
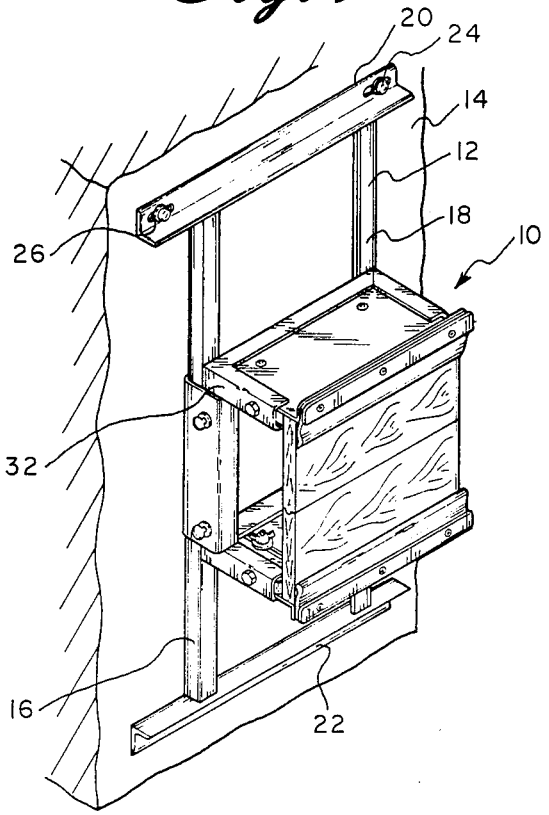
FIG. 1 is a perspective view of a holder for breakable karate boards constructed in accordance with the principles of the present invention and showing the same mounted by way of a bracket to a wall.

Referring now to the drawings in detail wherein like reference numerals have been used throughout the various figures to designate like elements, there is shown in FIG. 1 a holder for breakable karate boards constructed in accordance with the principles of the present invention and designated generally as 10. The holder 10 is shown mounted on a bracket 12 which, in turn, is mounted on a wall 14. The bracket 12 is comprised of a pair of vertical angle irons 16 and 18 secured together at their tops and bottoms by similar angle irons 20 and 22. The angle irons 20 and 22 are secured to the wall 14 through a plurality of bolts 24 which pass through elongated slotted openings such as shown at 26 in the angle irons. These slots allow for variations in the positions of the wall studs and insures that the bracket 12 can be mounted directly to such studs.

Figure 3:
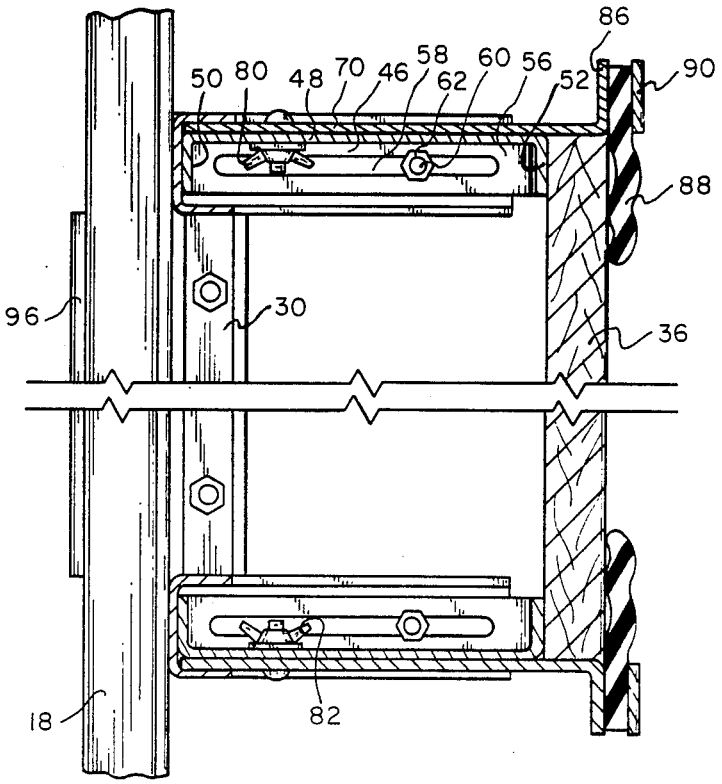
FIG. 3 is a cross-sectional view taken through the line 3—3 of FIG. 2.

The holder 10, per se, is comprised essentially of a pair of spaced apart vertical supports 28 and 30 (see FIGS. 7 and 3) and upper and lower substantially horizontal frame members 32 and 34, respectively. The upper and lower frame members 32 and 34 are spaced apart from each other substantially the distance of a breakable karate board 36 which is intended to be held thereby. The rear end of each of the frame members is secured to the vertical supports 28 and 30 and extends forwardly therefrom.

As will be readily apparent to those skilled in the art, the upper and lower frame members 32 and 34 are substantially identical to each other. The only difference being the orientation thereof. That is, the upper frame member 32 can be considered as facing downwardly whereas the lower frame member 34 can be considered to be facing upwardly. Furthermore, the holder is symmetrical in that the entire right half of the device is a mirror image of the left half thereof. Accordingly, as the description of the invention continues, reference may be made from time to time to only the upper frame member 32 or the lower frame member 34 or only the right or left side of the device. It will be understood that the remaining frame member or the other side of the device while not specifically described is constructed and functions in the identical manner as the portions which are being described.

The upper frame member 32 is comprised essentially of a U-shaped channel member 38 having a rear portion 40 and left and right forwardly extending portions 42 and 44, respectively. Slideably mounted within the channel member 38 and particularly the left and right portions 42 and 44 thereof, is a box-shaped member 46. The box 46 has a substantially planar upper wall 48, substantially vertical rear, front and side walls 50, 52, 54 and 56, respectively, extending downwardly from the upper wall 48 and an open bottom. As shown most clearly in FIG. 6, an elongated narrow slot 58 passes through the side wall 54 of the box 46. The slot 58 runs substantially the length of the box 48 from the front to the back thereof. Screws 60 pass through openings in the side walls of the side channel members 42 and 44 and continue through the slots 58 where they are engaged by a nut 62. The heads of the screws 60 are preferably hexagonally shaped such as shown at 64. A pair of elongated slotted openings 66 and 68 which are similar to slots 58 are formed in the upper wall 48 of the box 46 inwardly of the side edges thereof. The purpose for these slots 66 and 68 will become apparent hereinafter.

Also slideably mounted within the channel member 38 is a substantially planar plate 70. Bolts 76 and 78 pass downwardly from the plate 70 through spaced apart openings therein and through the slots 66 and 68 in the top wall 48 of the box member 46. Wing nuts 80, 82 and 84 are screwed onto these bolts and are accessible for manual operation from the sides of the holder 10 as shown in the various figures.

The forward end of the plate 70 is bent upwardly to form a flange 86. Secured to said flange 86 and extending substantially vertically downwardly therefrom is a wall 88 comprised of a semirigid rubbery material which may be natural or synthetic rubber or the like. A retaining plate 90 holds the wall 88 to the flange 86 through the use of a plurality of screws such as shown at 92. Thus, it can be seen that the free forward end of the upper frame member has a downwardly open elongated track having a horizontal wall formed by the forward end of the plate 70, a rear vertical wall formed by the wall 52 of the box member 46 (see FIG. 3) and a front vertical wall formed by the member 88. As should be readily apparent, the lower frame member 34 also includes a substantially identical upwardly open elongated track which generally faces the downwardly facing track of the upper frame member 32.

As stated above, the board holder 10 can be mounted on a wall through the use of wall bracket 12. This is accomplished by the use of a pair of U-shaped clamps 94 and 96. These clamps fit around the vertical angle irons 16 and 18 and around the vertical supports 28 and 30. Thumbscrews 98 pass through the clamps 94 and are screwed into the vertical supports 28 and 30.

Figure 7:
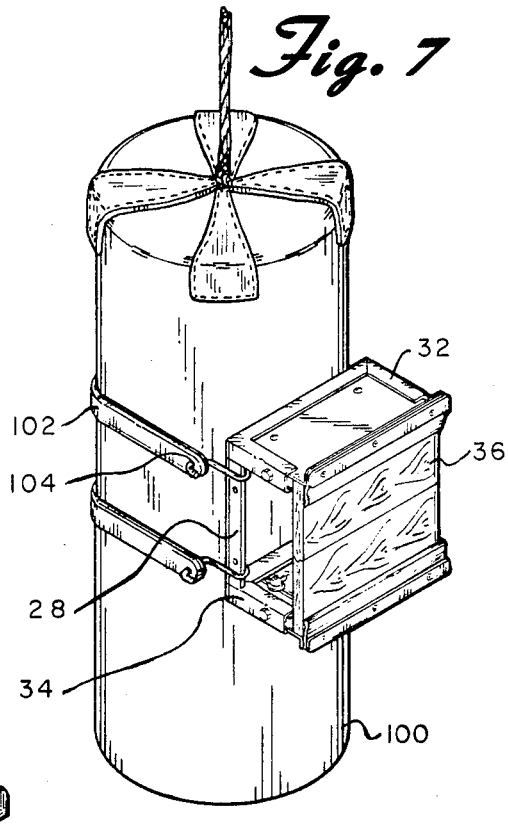
FIG. 7 is a perspective view similar to FIG. 1 but showing the holder removed from the wall brackets and mounting on a punching bag.

The overall width of the holder 10, per se, is slightly less than the distance between the vertical angle irons 16 and 18. Accordingly, with the thumbscrews 98 tightened, the clamps 94 and 96 are drawn inwardly so that the frame member 10 is clamped tightly to the bracket 12. With the thumbscrews 98 loosened, the holder 10 can be moved upwardly or downwardly into any desired position on the bracket 12 at which point the thumbscrews 98 are again tightened. With the thumbscrews fully loosened, the clamps 94 and 96 can be removed so that the holder 10 can be removed from the bracket 12. In this condition, the holder can be secured to substantially any other type of support means such as a punching bag 100 shown in FIG. 7. This can be easily accomplished through the use of elastic straps 102 having hooks 104 at the ends thereof. As shown in FIG. 7, the holder 10 is secured to the punching bag 100 without the clamps 94 and 96 secured thereto. It is also possible to replace the clamps 94 and 96 and to connect the hooks 104 to these clamps.

Figure 2:
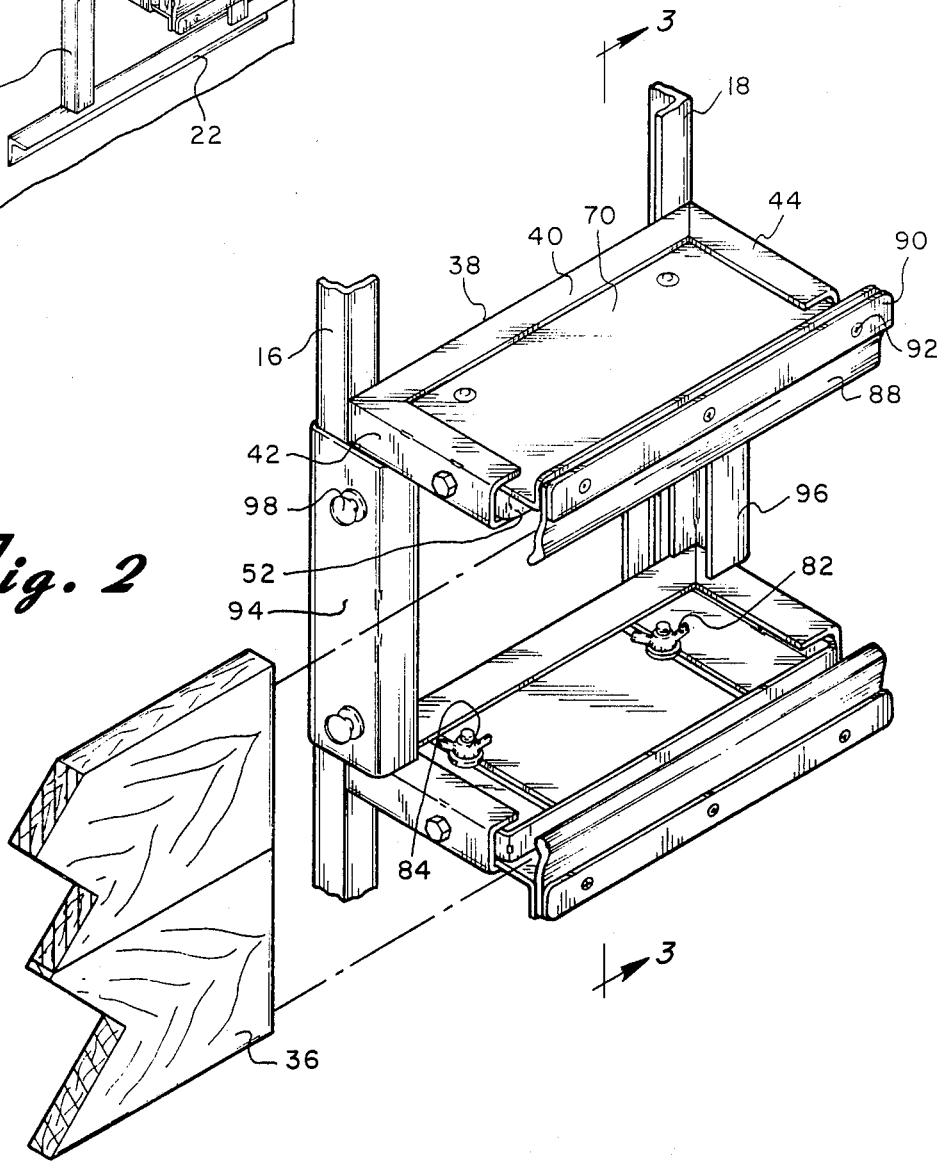
FIG. 2 is an enlarged view similar to FIG. 1 but showing the manner in which a board is inserted into the holder.

The holder 10 of the present invention is utilized in the following manner. As shown in FIG. 2, a board 36 is slid into the upper and lower tracks at the forward ends of the upper and lower frame members 32 and 34. The board is held relatively snugly in place since the semirigid walls 88 of the tracks are biased slightly inwardly thereby putting a small amount of pressure on the face of the board. Preferably board 36 is of the reusable type in which case it may be desirable to attach a string to the two board halves so that they can be easily retrieved once the board is struck and broken in half.

Figure 4:
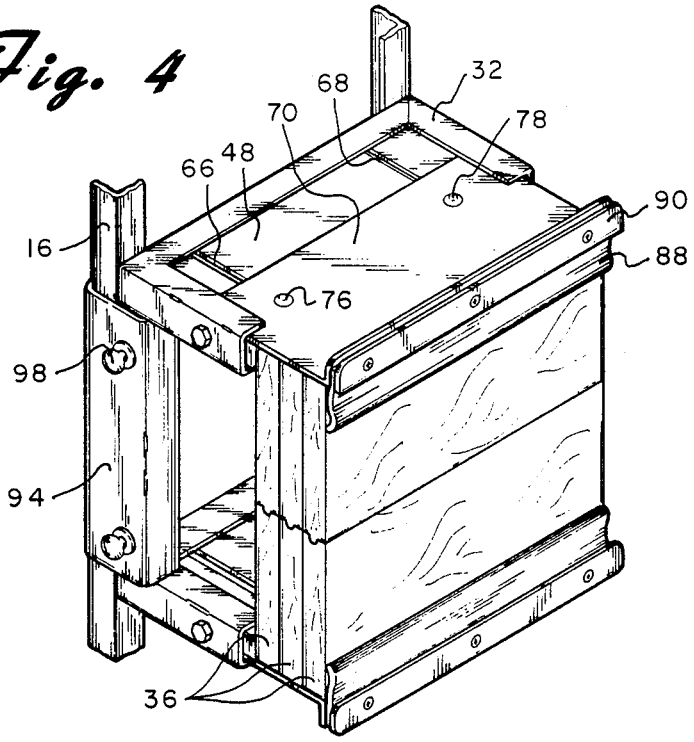
FIG. 4 is a view similar to FIGS. 1 and 2 but showing three boards being held.
Figure 5:
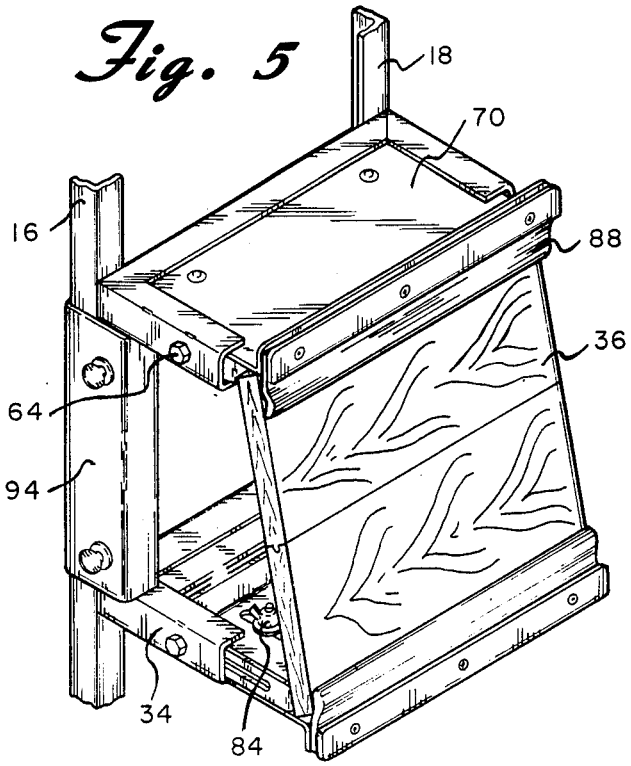
FIG. 5 is a perspective view showing a board being held in an upwardly and inwardly inclined position.
Figure 6:
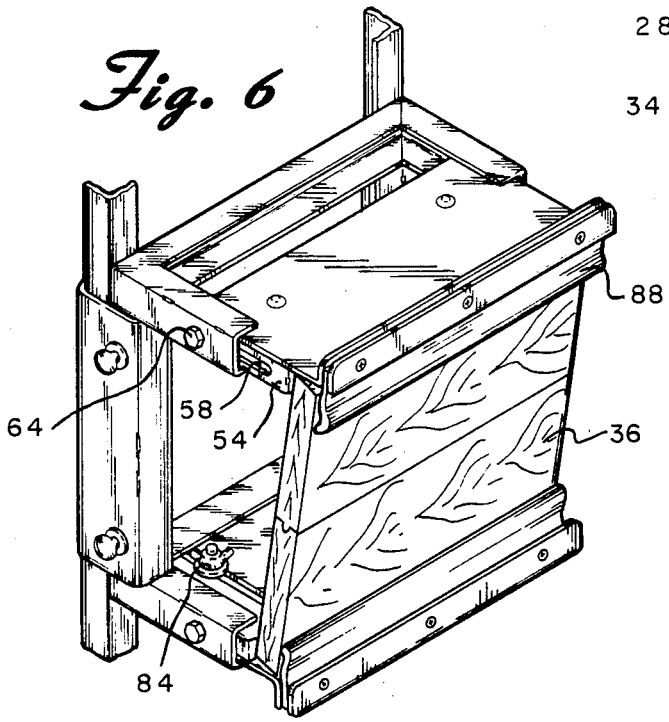
FIG. 6 is a view similar to FIG. 5 but showing a board being held in a downwardly and inwardly inclined position.

If it is desired to tilt the board vertically upwardly such as shown in FIG. 5, the heads 64 are rotated to loosen the lower screws associated therewith allowing the lower box-shaped member and the plate secured thereto to be slid forwardly thereby carrying the lower track outwardly. When the desired angle is achieved, the screws are again tightened. Likewise, if it is desired to tilt the board downwardly such as shown in FIG. 6, the upper screws 60 are loosened and the upper box-shaped member 46 along with plate 70 carried thereby can be slid forwardly until it is at its desired position at which point the screws are again tightened. Should it be desired to break more than one board 36, the tracks are easily widened by loosening all of the wing nuts 80, 82, 84, etc. and then sliding the upper plate 70 and the corresponding lower plate forwardly to the position such as shown at FIG. 4 wherein three boards can be held. At that position, the wing nuts are again tightened. It should be readily apparent that the tracks can be opened to substantially any desired position to hold one, two or more boards.

The present invention may be embodied in other specific forms without departing from the spirit or essential attributes thereof and accordingly reference should be made to the appended claims rather than to the foregoing specification as indicating the scope of the invention.

I claim:

1. A holder for breakable karate boards comprising:

an upper substantially horizontal frame member;

a lower substantially horizontal frame member vertically spaced from said upper frame member;

each of said frame members having a rear end secured to a vertical support and a forward front free end;

the free forward end of said upper frame member having a first downwardly open elongated track and the free end of said lower frame member having a second upwardly open elongated track generally facing said first track;

said first and second tracks being adapted to support at least one breakable karate board in a substantially vertical position, and means allowing said first and second tracks to be moved rearwardly and forwardly relative to each other so as to tilt a board being supported therein either upwardly and inwardly or downwardly and inwardly and including means for locking said tracks in relative position to each other.

2. The holder as claimed in claim 1 wherein said tracks are adjustable so that more than one board can be supported therein.

3. The holder as claimed in claim 1 further including a wall mounted bracket and wherein said vertical support is releasably mounted on said bracket.

4. The holder as claimed in claim 3 wherein said support is vertically movable with respect to said bracket so that the height of said board can be adjusted.

5. The holder as claimed in claim 1 wherein each track is comprised of a horizontal wall and front and rear vertical walls and wherein each of said front vertical walls is comprised of a semirigid rubbery material.

* * * * *